US006650232B1

(12) United States Patent
Strohbeck et al.

(10) Patent No.: US 6,650,232 B1
(45) Date of Patent: Nov. 18, 2003

(54) SOUNDER CONTROL SYSTEM

(75) Inventors: Walter Friedrich Strohbeck, Narre Warren (AU); Roderick John Pettit, Wantirna South (AU)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/269,132

(22) PCT Filed: Sep. 11, 1997

(86) PCT No.: PCT/AU97/00598

§ 371 (c)(1),
(2), (4) Date: Sep. 27, 1999

(87) PCT Pub. No.: WO98/11666

PCT Pub. Date: Mar. 19, 1998

(30) Foreign Application Priority Data

Sep. 11, 1996 (AU) ..... PO 2245

(51) Int. Cl.[7] ..... G08B 3/10

(52) U.S. Cl. ..... 340/384.7; 340/425.5; 381/94.1; 381/120

(58) Field of Search ..... 340/384.7, 425.5, 340/426, 407.1, 531, 506, 628, 691, 584, 539, 825.32, 825.25, 384.4, 384.5, 384.6, 384.73, 428, 449; 381/56, 120, 94.1, 94.9, 94.5; 307/10.2

(56) References Cited

U.S. PATENT DOCUMENTS

| | | | | | |
|---|---|---|---|---|---|
| 4,117,262 | A | * | 9/1978 | Peecher | 381/56 |
| 4,180,809 | A | * | 12/1979 | Feldstein | 381/56 |
| 5,009,281 | A | * | 4/1991 | Yokoyama | 381/96 |
| 5,046,101 | A | | 9/1991 | Lovejoy | 381/57 |
| 5,266,921 | A | * | 11/1993 | Wilson | 340/388 |
| 5,278,537 | A | * | 1/1994 | Carlo et al. | 340/384.1 |
| 5,410,592 | A | * | 4/1995 | Wagner et al. | 379/388 |
| 5,461,367 | A | | 10/1995 | Altavela et al. | 340/584 |
| 5,651,070 | A | * | 7/1997 | Blunt | 381/56 |
| 5,745,040 | A | * | 4/1998 | Lourghridge | 340/628 |
| 5,745,587 | A | * | 4/1998 | Statz et al. | 381/120 |
| 5,878,283 | A | * | 3/1999 | House et al. | 396/6 |
| 6,005,478 | A | * | 12/1999 | Boreham et al. | 340/425.5 |
| 6,097,289 | A | * | 8/2000 | Li et al. | 340/431 |

FOREIGN PATENT DOCUMENTS

| | | |
|---|---|---|
| DE | 35 19 253 | 12/1985 |
| DE | 42 16 166 | 1/1993 |
| DE | 42 18 166 | 1/1993 |
| EP | 0 558 918 | 9/1993 |
| EP | 0 624 947 | 11/1994 |
| EP | 0 687 614 | 12/1995 |
| WO | WO 92/18955 | 10/1992 |

* cited by examiner

*Primary Examiner*—Benjamin C. Lee
(74) *Attorney, Agent, or Firm*—Kenyon & Kenyon

(57) ABSTRACT

A sounder control system, including a converter circuit for converting a drive signal to a signal for activating a sounder and a drive circuit for generating the drive signal. The drive circuit includes a microprocessor for receiving at least one input signal representative of one of a plurality of control parameters for the sounder control system and for adjusting the drive signal on the basis of the at least one input signal, such that the sounder exhibits a predetermined sound pressure level characteristic.

19 Claims, 4 Drawing Sheets

SOUNDER CONTROL SYSTEM

BACKGROUND INFORMATION

The present invention relates to a sounder control system.

Sirens employed in vehicle alarm systems include piezoelectric sounders or speakers which are powered by a voltage supply from the vehicle battery. In the event that supply from the vehicle battery fails or is disconnected, a backup battery is provided to ensure the siren can still be activated. Most vehicle alarm systems are configured, for example, to activate the siren if the vehicle battery is disconnected when the alarm system is armed. The backup battery however is normally only able to provide about a 6–9V supply to the siren, instead of the normal 12V supply provided by the vehicle's battery, and this gives rise to a significant drop in the performance of and sound pressure level generated by the siren. The other difficulty encountered with existing vehicle sirens is that the sound pressure level generated varies considerably across the frequency range for which the siren is to be activated, primarily because of a sounder's resonance behaviour. It is desirable to be able to provide a vehicle siren which generates a predetermined sound pressure level regardless of supply voltage, signal frequency, temperature or component tolerances.

SUMMARY OF THE INVENTION

In accordance with the present invention there is provided a sounder control system, including a converter circuit for converting a drive signal to a signal for activating a sounder and a drive circuit for generating said drive signal. The drive circuit includes a microprocessor for receiving at least one input signal representative of one of a plurality of control parameters for the sounder control system and for adjusting the drive signal on the basis of the at least one input signal, such that said sounder exhibits a predetermined sound pressure level characteristic.

The present invention also provides a sounder control system, including a converter circuit for converting a drive signal to a signal for activating a sounder and a drive circuit for generating the drive signal. The drive circuit includes a microprocessor for receiving a voltage signal representative of the level of a supply voltage for the sounder control system and for adjusting the drive signal on the basis of the voltage signal, such that the sounder exhibits a predetermined sound pressure level characteristic.

The present invention further provides a sounder control system, including a converter circuit for converting a drive signal to a signal for activating a sounder and a drive circuit for generating said drive signal. The drive circuit includes a microprocessor for receiving a temperature signal representative of the temperature inside a housing of the system and the sounder and for adjusting the drive signal on the basis of the temperature signal, such that the sounder exhibits a predetermined sound pressure level characteristic.

The present invention also provides a siren control system that includes a transformer with a secondary coil connected across a sounder and a primary coil, a switch connected to said primary coil to cause current to flow in the primary coil when activated, and a control device for controlling activation of the switch such that said sounder exhibits a predetermined sound pressure level characteristic.

DETAILED DESCRIPTION

Figure 1:
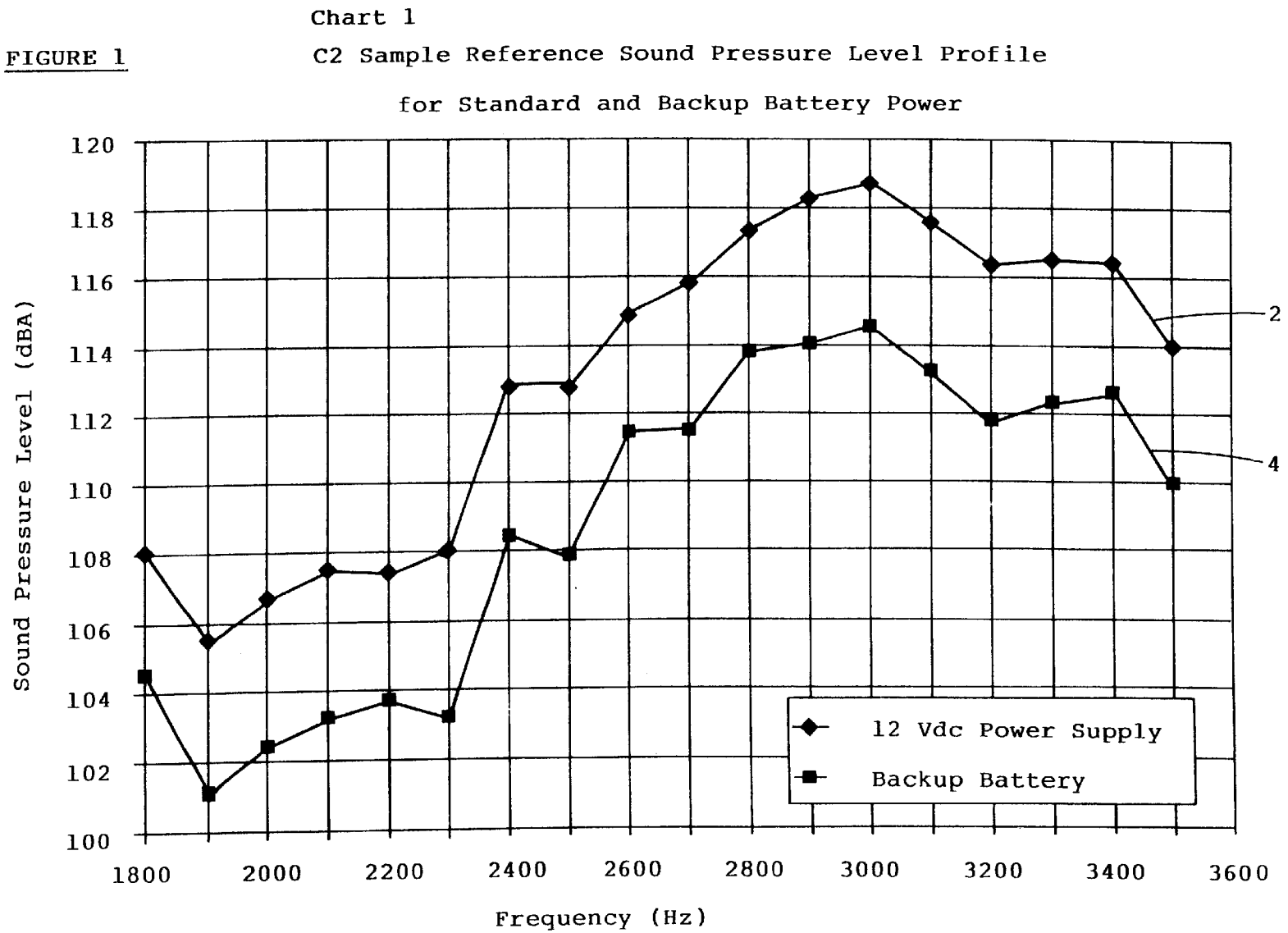
FIG. 1 is a graph of sound pressure level versus frequency for a piezoelectric siren.

The sound pressure level generated or output by a piezoelectric siren peaks at one frequency and drops off dramatically for other frequencies, as shown in FIG. 1. The graphs 2 and 4 of FIG. 1 show the sound pressure level generated when the drive or activation signal is swept across 1800 to 3600 hertz to produce a wailing sound from the siren. The first graph 2 is the levels generated when a 12 volt DC supply from the vehicle battery is available and the second graph 4 is the levels produced when a backup battery of the vehicle alarm system is used to provide the voltage supply for the siren.

Figure 2:
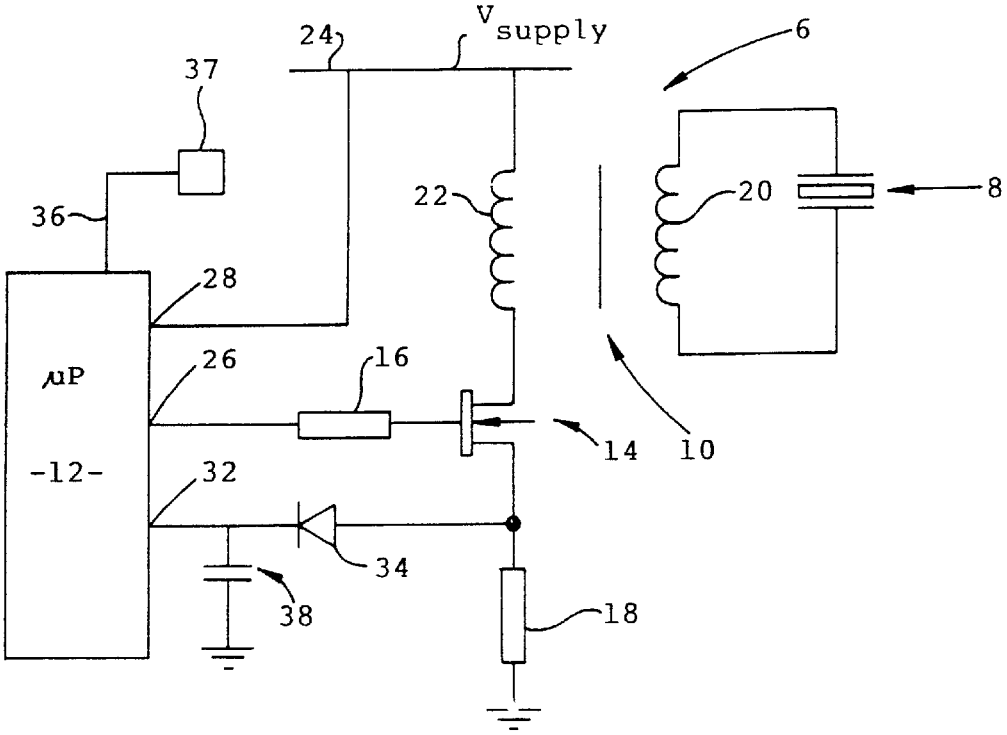
FIG. 2 is a circuit diagram of a first embodiment of a siren control system according to the present invention.

A first siren control system 6, as shown in FIG. 2, is for the siren of a vehicle alarm system. The siren includes a piezoelectric sounder or speaker 8 and the control system 6. The control system 6 includes a transformer 10, a microprocessor 12, a field effect transistor (FET) 14 and two bias resistors 16 and 18. The piezoelectric sounder 8 acts as a capacitor and is connected in parallel to the secondary coil 20 of the transformer 10. The primary coil 22 of the transformer 10 is connected between a voltage supply line 24 and the drain of the transistor 14. The voltage $V_{supply}$ of the line 24 is normally the voltage of the vehicle battery, about 12 volts DC, or the voltage provided by the backup battery of the alarm system, normally 6 volts, if the vehicle battery is disconnected or is unable to supply the vehicle battery voltage. The gate of the transistor 14 is connected to an output port 26 of the microprocessor 12 via the first bias resistor 16. The source of the transistor 14 is connected to ground by the second bias resistor 18 which also acts as a current limiter.

Figure 3:
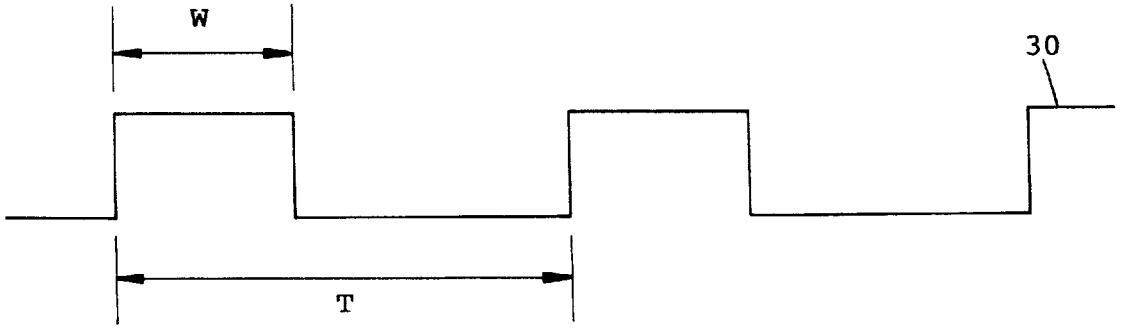
FIG. 3 is a timing diagram of a PWM signal.

Activating the transistor 14 to connect the source to the drain causes current to be drawn through the primary coil 22 so as to generate a secondary current in the secondary coil 20 which charges the sounder 8 to cause it to emit sound. Once the sounder 8 is sufficiently charged, the transistor 14, acting as a switch can be deactivated so as to allow current to be drawn through the sounder 8 as it discharges. The higher the supply voltage supplied, the higher the charge of the sounder 8. The current in the secondary coil 20, and activation of the sounder 8, is controlled by a pulse width modulation (PWM) signal 30, as shown in FIG. 3, generated at the output 26 of the microprocessor 12. The sound pressure level or energy generated by the sounder 8 is dependent on the electrical energy or current supplied to the sounder 8, which is governed by the time and frequency for which the transistor 14 is activated or switched on. The transistor 14 is switched on for the entire width W of a pulse of the PWM signal 30. A decrease or increase in the pulse width W correspondingly decreases or increases the sound pressure level generated by the sounder 8. The frequency of the sound generated by the sounder 8 is determined by the frequency f of PWM signal 30 which relates directly to the period T between pulses. The siren is therefore swept over a range of frequencies between 1800–3600 hertz by gradually decreasing the period T of PWM signal 30. The pulse width W is increased or decreased depending on the level of the voltage $V_{supply}$ on the line 24 as detected at an input 28 of the microprocessor 12. The pulse width W and the period T of the PWM signal 30 at any given time is determined by values stored in memory of the microprocessor 12. The microprocessor 12 calculates the periods T for the required frequency sweeps and the pulse widths W from data stored in look-up tables in the memory of the microprocessor 12, and which is accessed using the frequency f as a pointer. The level of the supply voltage $V_{supply}$ is also used as a pointer to data used to determine to output pulse width. As discussed below, other control parameters, such as temperature, may also be used as pointers. The values used to determine the output PWM signal are chosen and stored to ensure a predetermined sound pressure level is obtained over the entire frequency band of the sweep, regardless of the level of supply of the supply voltage $V_{supply}$. For example, the sound pressure level may be set at 116 dba for the desired frequency sweep. Of course the sound pressure levels and the frequencies which can be used will differ depending on a country's regulations and the type of the piezoelectric sounder 8 which is used. Therefore the data used to generate the pulse widths W and the periods T, i.e. the basic duty cycle, is selected and stored accordingly with these parameters in mind. The input port 28 connects $V_{supply}$ to an analog to digital converter of the microprocessor 12 which uses the converted signal as a pointer to the processor's calibratable (EEPROM) memory. The level of the supply $V_{supply}$ is used to select a pulse width correction factor $C_v$ from a look-up table which is used to adjust the width W at the output port 26. The output pulse width (OPW) at the output port 26 is then $C_v \times W$.

If a temperature sensor 37 is placed on a printed circuit board of the system 6, an electrical signal generated by the sensor 37 is fed back to the microprocessor 12 on a line 36. The temperature value t represented by this signal is then used with the frequency f and the supply voltage $V_{supply}$ as pointers for the look-up tables to obtain the output PWM signal. The temperature t relates to the ambient temperature inside a sealed housing of the siren which includes the system 6 and the sounder 8. The temperature t is used to access a temperature correction look-up table to obtain a temperature correction factor $C_t$. The pulse width at the output port 26 is then calculated by the microprocessor 12 as follows $$OPW = C_v \times C_t \times W \tag{1}$$

The microprocessor 12 calculates, as described above, the pulse widths W and periods T for a basic pulse to produce a predetermined basic sound pressure level characteristic. The pulse widths W and periods T are calculated using the frequency f. The frequency f can also be used to access a frequency correction look-up table to obtain a frequency correction factor $C_f$. The pulse width at the output port 26 can then be adjusted as follows $$OPW = C_v \times C_t \times C_f \times W \tag{2}$$

The control system 6 employs efficient and close control of the piezoelectric sounder 8 by obtaining feedback concerning the sound energy generated by the sounder 8. Sound energy feedback enables the sounder 8 to be driven at maximum efficiency whilst taking into account tolerances of the transformer 10 and the sounder 8 as well as temperature drifts of the components. Feedback concerning the sound energy can be obtained by monitoring either the current of the primary coil 22, the current of the secondary coil 20 or the voltage across the secondary coil 20.

A signal representative of the primary current of the coil 22 is taken from the source of the transistor 14 and inputted into an analog input 32 of the processor 12 via a diode 34, as shown in FIG. 2. The diode 34 has a cathode connected to the input 32 and its anode connected to the source of the transistor 14. A grounded capacitor 38 is connected across the input 32. Upper and lower current limits are stored in the microprocessor 12 so as to define an acceptable primary current operating range for the piezoelectric sounder 8, and the microprocessor 12 modifies the pulse width W at the output 26 to ensure the current sensed at the input 32 is within the predetermined range. The pulse width W is incremented or decremented until the sensed current falls within the predetermined range. The level of the feedback signal can be used to generate a value X to adjust the pulse width at the output port 26 at predetermined intervals. For example, the output pulse width can be derated or increased by X % every Y ms. At this time, the output pulse width could be determined by $$OPW = C_v \times C_f \times C_t \times \left(1 + \frac{X}{100}\right) \times W \tag{3}$$

Figure 4:
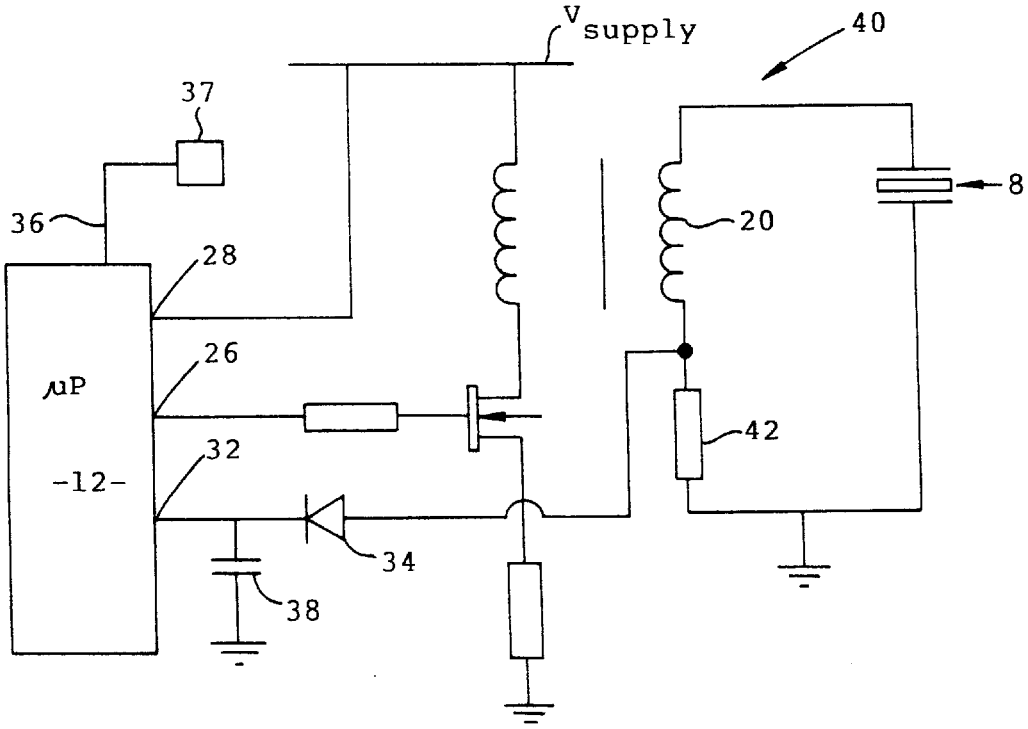
FIG. 4 is a circuit diagram of a second embodiment of a siren control system according to the present invention.
Figure 5:
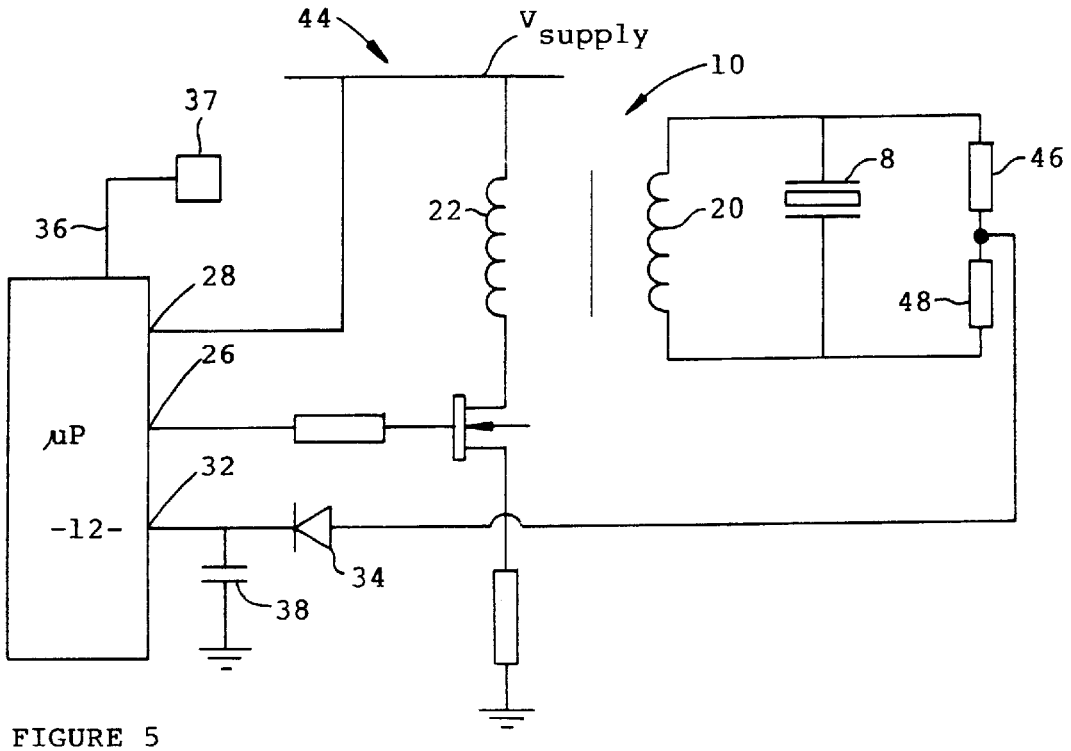
FIG. 5 is a circuit diagram of a third embodiment of a siren control system according to the present invention.

In a second control system 40 as shown in FIG. 4, the secondary current is alternatively supplied to the input 32 by connecting the anode of the diode 34 to a connection point between the secondary coil 20 and a resistor 42 placed between the coil 20 and the sounder 8. A third control system 44, as shown in FIG. 5, illustrates a further alternative where a voltage representative of the voltage across the secondary coil 20 and the sounder 8 can be obtained from between two resistors 46 and 48 connected across the sounder 8 and provided to the anode of the diode 34. The resistors 46 and 48 provide a voltage divider across the secondary coil 20. For the third control system 44, the operating range defined in the microprocessor 12 is with reference to the voltage across the second resistor 48. Therefore current and voltage sensing can be provided and fed back to the input 32 with only the addition of a minor number of passive components.

Figure 7:
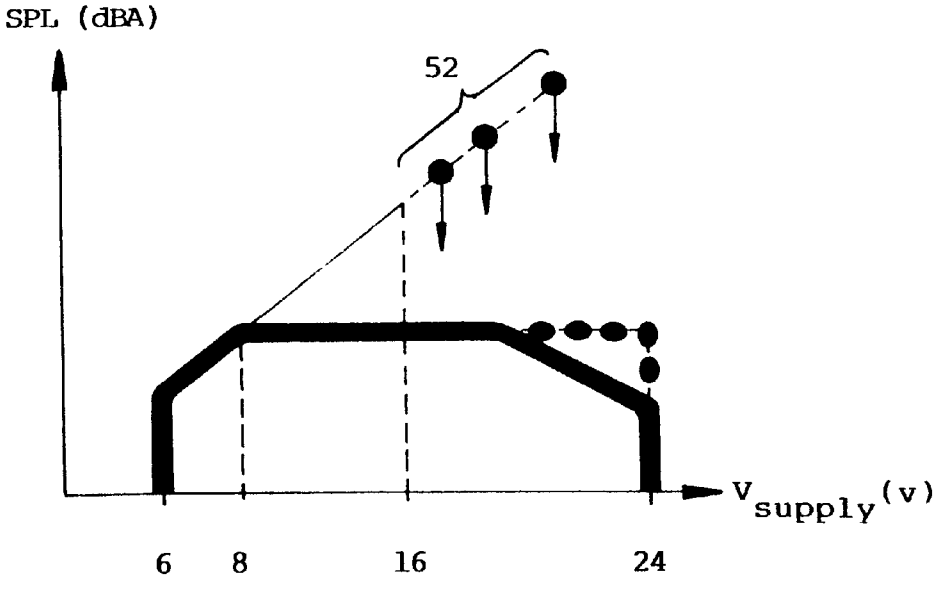
FIG. 7 is a graph of sound pressure level versus supply voltage for a siren control system.
Figure 6:
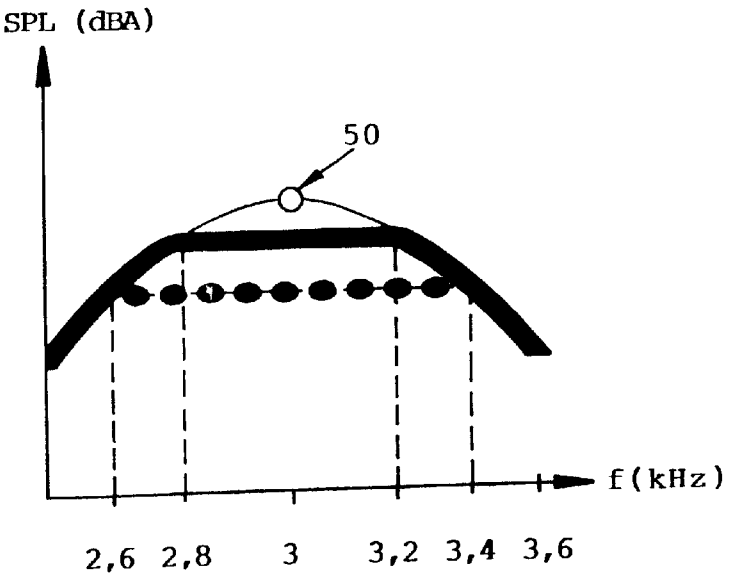
FIG. 6 is a graph of sound pressure level versus frequency for a siren control system.

The siren control systems 6, 40 and 44 are able to control the sound pressure level (SPL) characteristic of the sounder 8 to the extent that a desired or predetermined SPL characteristic can be produced regardless of the level of the supply voltage. The graphs of FIGS. 6 and 7 illustrate three SPL characteristics, with reference to frequency in FIG. 6 and with reference to supply voltage in FIG. 7. The natural characteristic of the sounder 8 is represented by the fine line, and FIG. 6 shows how the natural characteristic includes a resonant point 50 and tapers off on either side of the point 50. FIG. 7 shows how the SPL increases linearly with supply voltage until a characteristic point of destruction 52 of the sounder 8 is reached. To prevent destruction of the sounder 8 at high supply voltages, and to provide a constant SPL regardless of supply voltage, the SPL frequency response is set to be constant over a predetermined frequency range by adjusting the natural characteristic to produce a desired predetermined characteristic as shown in bold in FIGS. 6 and 7. An alternative flatter frequency characteristic, as shown by the dotted line in FIG. 6, may be desired to prevent the SPL dropping off at high supply voltages, as shown by the dotted line in FIG. 7.

The control systems 6, 40 and 44 produce a constant sound pressure level output across a frequency range thereby fully utilising the piezoelectric speaker. The constant sound pressure level output is also achieved independent of supply voltage, and local requirements and restrictions can be taken into account.

The control systems 6, 40 and 44 are closed loop control systems which allow optimal use of the piezoelectric sounder 8 and the available supply voltage whilst compensating against component tolerances, and temperature tolerances, which is particularly advantageous when the sounder 8 is driven by a backup power source, such as the backup battery. A constant high sound pressure level can also be generated from the sounder 8 through operation close to the destruction point of the piezoelectric sounder 8, thereby extending the operating range of the siren system.

The control systems 6, 40 and 44 whilst particularly advantageous for piezoelectric sounders 8 can also be used beneficially with other sounders, such as loudspeakers.

What is claimed is:

1. A sounder control system, comprising:

a sounder;

a drive circuit for generating a drive signal, the drive circuit including a microprocessor for receiving a voltage signal representative of a level of a supply voltage for the sounder control system and for adjusting the drive signal on the basis of the voltage signal, such that the sounder exhibits a predetermined sound pressure level characteristic; and a converter circuit for converting the drive signal to a signal for activating the sounder.

2. The sounder control system according to claim 1, wherein the drive signal depends on a temperature inside a housing of the sounder control system and the sounder.

3. The sounder control system according to claim 1, wherein:

the supply voltage includes a vehicle supply voltage.

4. A sounder control system, comprising:

a sounder;

a drive circuit for generating a drive signal, the drive circuit including a microprocessor for receiving a temperature signal representative of a temperature inside a housing of the sounder control system and the sounder and for adjusting the drive signal on the basis of the temperature signal, such that the sounder exhibits a predetermined sound pressure level characteristic; and a converter circuit for converting the drive signal to a signal for activating the sounder.

5. The sounder control system according to claim 4, wherein the drive signal depends on a level of a supply voltage for the sounder control system.

6. The sounder control system according to claim 4, further comprising:

a feedback circuit for providing a feedback signal representative of one of a load and an energy of the sounder to the microprocessor, wherein the drive signal depends on a level of the feedback signal.

7. The sounder control system according to claim 6, wherein the microprocessor adjusts the drive signal when the level of the feedback signal is outside a predetermined range.

8. The sounder control system according to claim 6, wherein, in response to the feedback signal, the microprocessor adjusts the drive signal to maximize the predetermined sound pressure level characteristic without damaging the sounder.

9. The sounder control system according to claim 4, wherein the predetermined sound pressure level characteristic corresponds to a sound pressure level that is substantially constant for a range of the predetermined sound pressure level characteristic.

10. The sounder control system according to claim 4, wherein:

the drive signal is a PWM signal generated by the microprocessor, and the PWM signal is adjusted by adjusting a pulse width of the PWM signal.

11. The sounder control system according to claim 10, wherein the pulse width of the PWM signal depends on a frequency of the PWM signal.

12. The sounder control system according to claim 10, wherein the pulse width of the PWM signal is adjusted by at least one stored correction factor accessed from at least one look-up table.

13. A siren control system, comprising:

a sounder;

a transformer including a secondary coil and a primary coil, the secondary coil connected across the sounder and the primary coil;

a switch connected to the primary coil to cause a current to flow in the primary coil when the switch is activated; and a control device for controlling an activation of the switch, such that the sounder exhibits a predetermined sound pressure level characteristic;

wherein the predetermined sound pressure level characteristic corresponds to a sound pressure level that is substantially constant for a range of the predetermined sound pressure level characteristic;

wherein the control device generates a PWM signal to activate the switch; and wherein the PWM signal includes a pulse width determined based on a level of a supply voltage for the primary coil.

14. The siren control system according to claim 13, wherein the pulse width of the PWM signal depends on a temperature inside a housing of the siren control system and the sounder.

15. The siren control system according to claim 13, further comprising:

a feedback device for providing a feedback signal representative of one of a load and an energy of the sounder to the control device, wherein the pulse width of the PWM signal depends on a level of the feedback signal.

16. The siren control system according to claim 15, wherein the control device adjusts the pulse width of the PWM signal when the feedback signal is outside a predetermined range.

17. The siren control system according to claim 16, wherein the control device activates the switch to maximize the sound pressure level without damaging the sounder in response to the feedback signal.

18. The siren control system according to claim 16, wherein the pulse width of the PWM signal depends on a frequency of the PWM signal.

19. The sounder control system according to claim 13, wherein:

the supply voltage includes a vehicle supply voltage.

* * * * *